US010358764B2

(12) United States Patent
Lukas et al.

(10) Patent No.: US 10,358,764 B2
(45) Date of Patent: Jul. 23, 2019

(54) STEAM IRON COMPRISING A HEATING BODY PROVIDED WITH A STEAM CHAMBER AND AN IRONING SURFACE THERMALLY CONNECTED TO THE HEATING BODY

(71) Applicant: Rowenta Werke GmbH, Erbach (DE)

(72) Inventors: Andrea Lukas, Offenbach (DE); Bjorn Scheve, Reichelsheim (DE); Dierk Spatz, Erbach (DE)

(73) Assignee: Rowenta Werke GmbH, Erbach (DE)

( * ) Notice: Subject to any disclaimer, the term of this patent is extended or adjusted under 35 U.S.C. 154(b) by 34 days.

(21) Appl. No.: 15/596,662

(22) Filed: May 16, 2017

(65) Prior Publication Data

US 2017/0335506 A1 Nov. 23, 2017

(30) Foreign Application Priority Data

May 17, 2016 (EP) ..... 16170011

(51) Int. Cl.

| | |
|---|---|
| ***D06F 75/24*** | (2006.01) |
| ***D06F 75/18*** | (2006.01) |
| ***D06F 75/20*** | (2006.01) |
| ***D06F 75/38*** | (2006.01) |

(52) U.S. Cl.

CPC ..... *D06F 75/24* (2013.01); *D06F 75/18* (2013.01); *D06F 75/20* (2013.01); *D06F 75/38* (2013.01)

(58) Field of Classification Search

CPC ..... D06F 75/00–40
USPC ..... D32/68–73
See application file for complete search history.

(56) References Cited

U.S. PATENT DOCUMENTS

| | | | | |
|---|---|---|---|---|
| 2,299,202 A * | 10/1942 | Bass | D06F 75/38 | 38/141 |
| 2,880,530 A * | 4/1959 | Schwaneke | D06F 75/18 | 38/144 |
| 3,192,654 A * | 7/1965 | Weaver | D06F 75/20 | 38/77.9 |
| 3,721,026 A * | 3/1973 | McCallum | D06F 43/002 | 38/75 |
| 4,642,922 A * | 2/1987 | Prudenziati | D06F 75/38 | 38/81 |
| 4,837,952 A * | 6/1989 | Hennuy | D06F 75/18 | 38/77.7 |

(Continued)

FOREIGN PATENT DOCUMENTS

| | | |
|---|---|---|
| EP | 0380896 A1 | 8/1990 |
| EP | 1772551 A1 | 4/2007 |

(Continued)

*Primary Examiner* — Ismael Izaguirre
(74) *Attorney, Agent, or Firm* — The Webb Law Firm

(57) ABSTRACT

Steam iron comprising a heating body (3) comprising a steam chamber (32) and an ironing surface (52) connected thermally to the heating body (3), the ironing surface (52) being designed to come into contact with the fabric to be ironed, and being advantageously provided with steam release holes (50), the heat produced by the heating body (3) being transferred to the ironing surface (52) by conduction through at least two components (3, 4) of the iron, pressed together, characterized in that the two components (3, 4) are in direct contact with one another at at least one point of contact (40A) with a contact surface area of less than 2 $mm^2$ and preferably less than 1 $mm^2$.

17 Claims, 4 Drawing Sheets

(56) References Cited

U.S. PATENT DOCUMENTS

| | | | | |
|---|---|---|---|---|
| 4,995,177 | A | 2/1991 | Louison et al. | |
| 7,305,780 | B2 | 12/2007 | Lukas et al. | |
| 7,610,701 | B2 * | 11/2009 | Cavada | D06F 75/246 38/77.82 |
| 7,690,140 | B2 * | 4/2010 | Ho | D06F 75/38 38/97 |
| 2015/0330014 | A1 * | 11/2015 | Mohankuma | D06F 75/14 38/144 |

FOREIGN PATENT DOCUMENTS

| | | | |
|---|---|---|---|
| FR | 1424320 | | 1/1966 |
| FR | 2798403 | A1 | 3/2001 |
| WO | 89/08372 | A1 | 9/1989 |

* cited by examiner

STEAM IRON COMPRISING A HEATING BODY PROVIDED WITH A STEAM CHAMBER AND AN IRONING SURFACE THERMALLY CONNECTED TO THE HEATING BODY

CROSS-REFERENCE TO RELATED APPLICATION

This application claims priority to European Patent Application No. 16170011.7 filed May 17, 2016, the disclosure of which is hereby incorporated in its entirety by reference.

FIELD OF THE INVENTION

This invention pertains to a steam iron comprising a heating body comprising a steam chamber and an ironing surface thermally connected to the heating body, the ironing surface being designed to come into contact with the fabric to be ironed, and being advantageously provided with steam release holes, and pertains more specifically to an iron in which the heat produced by the heating body is transferred to the ironing surface by conduction through at least two components of the iron pressed together while the iron is being assembled.

DESCRIPTION OF RELATED ART

There already exists, in patent application FR 2 798 403 filed by the applicant, a steam iron comprising a soleplate comprising a heating body comprising a steam chamber for producing steam and an ironing surface thermally connected to the heating body, the ironing surface being designed to come into contact with the fabric to be ironed and being provided with steam release holes. In this document, the ironing surface is held by a cap, which is pressed onto the heating body, the heat produced by the heating body being transferred to the ironing surface by conduction through the heating body, and then through a cap, the latter being in contact with the heating body in the location of the contact areas consisting of distribution channel walls and of thermal transfer contacts.

Constructing an iron this way makes it possible to limit the thermal flow moving toward the ironing surface, in order to have a heating body temperature near the steam chamber that is sufficient for ensuring that the water turns to steam, even when the ironing surface is at a low temperature, making it possible to iron delicate fabrics.

However, such a construction presents the disadvantage of relying on contacts held in place by the casting, which are relatively large and cause high thermal conduction locally. Such contacts thus create significant limitations for the design of the casting, and can create significant hot points on the ironing surface.

Consequently, one purpose of this invention is to propose a steam iron that remedies these disadvantages and that possesses a structure that is simple and inexpensive to produce.

SUMMARY OF THE INVENTION

To this end, the objective of the invention is a steam iron comprising a heating body comprising a steam chamber and an ironing surface connected thermally to the heating body, the ironing surface being designed to come into contact with the fabric to be ironed and being advantageously provided with steam release holes, the heat produced by the heating body being transferred to the ironing surface by conduction through at least two components of the iron pressed together, characterized in that the two components are in direct contact with one another in the location of at least one point of contact with a contact surface area of less than 2 $mm^2$ and preferably less than 1 $mm^2$.

The phrase "two components of the iron pressed together," refers to two components comprising the iron that have been produced independently of one another and then pressed together during the iron assembly process.

Such a characteristic makes it possible to establish a local point of contact that diffuses little energy by thermal conduction, while providing a mechanical connection between the two components.

According to another characteristic of the invention, the two components are in direct contact with one another at several points of contact, all of the points of contact having a contact surface area of less than 2 $mm^2$ and preferably less than 1 $mm^2$.

Such a characteristic makes it possible to distribute the thermal diffusion by conduction between the two components at the several points of contact with low thermal diffusivity, for a more even heat distribution and better mechanical hold between the two components.

According to another characteristic of the invention, the iron comprises at least three points of contact and preferably between 10 and 30 points of contact between the two components.

According to another characteristic of the invention, the points of contact are situated at the ends of protrusions extending over one surface of at least one of the components.

According to another characteristic of the invention, the protrusions are obtained through a stamping process.

Such a characteristic makes it possible to produce the protrusions in a simple, inexpensive manner.

According to another characteristic of the invention, the one or more protrusions extend to a height of 0.3 mm and advantageously of between 0.4 mm and 0.8 mm.

Such a height makes it possible to arrange a space with a height between the two components that makes it possible to limit thermal diffusion by radiation.

According to another characteristic of the invention, a steam distribution chamber is arranged between the two components.

Such a characteristic makes it possible to take advantage of the space arranged between the two components in order to circulate the steam and distribute it over the entire surface of the components.

According to another characteristic of the invention, a gasket is arranged between the two components at the periphery of the distribution chamber.

Such a characteristic makes it possible to prevent the steam from escaping at the periphery of the two components.

According to another characteristic of the invention, the soleplate comprises a plate that is pressed against the heating body, the one or more point(s) of contact being situated at the interface between the heating body and the plate.

Thus, the heating body and the plate constitute the two components of the iron that are pressed together and that have points of contact that are small in surface area.

According to another characteristic of the invention, the points of contact are distributed over the length of the periphery of the ironing surface.

According to another characteristic of the invention, the plate is made of aluminum.

Such a characteristic makes it possible to ensure high thermal conduction within the thickness of the plate.

According to another characteristic of the invention, the iron comprises a cap, advantageously made of stainless steel, which is pressed against the plate, the ironing surface being supported by the cap.

Such a characteristic makes it possible to combine both good temperature evenness on the ironing surface due to the good thermal diffusion occurring through the aluminum plate and good scratch resistance of the ironing surface when the cap is made of a scratch-resistant material such as stainless steel.

According to another characteristic of the invention, the plate is attached to the heating body by means of a screw, the cap being attached to the plate by turning down the edges of the cap over the edges of the plate.

According to another characteristic of the invention, the heating body is a casting encapsulating an electric resistor.

According to another characteristic of the invention, the electric resistor is the only heating element of the iron.

BRIEF DESCRIPTION OF THE DRAWINGS

The objectives, aspects and advantages of this invention will be better understood through the description provided below of one particular embodiment of the invention, presented as a non-limiting example, in reference to the attached drawings, in which.

DETAILED DESCRIPTION OF THE INVENTION

Figure 1:
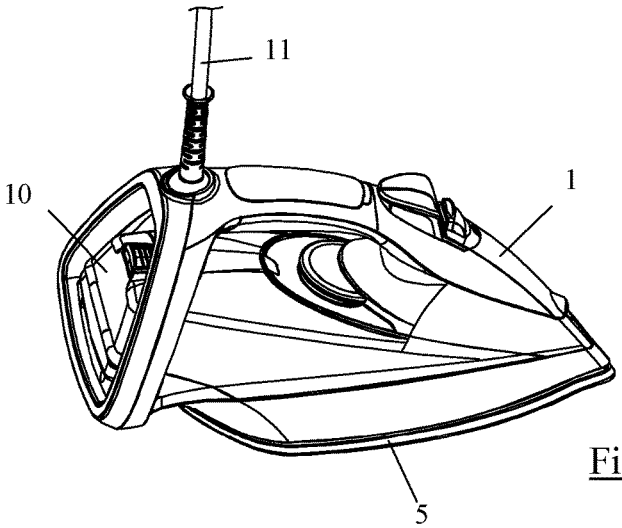
FIG. 1 is a perspective view of an iron according to one particular embodiment of the invention.
Figure 2:
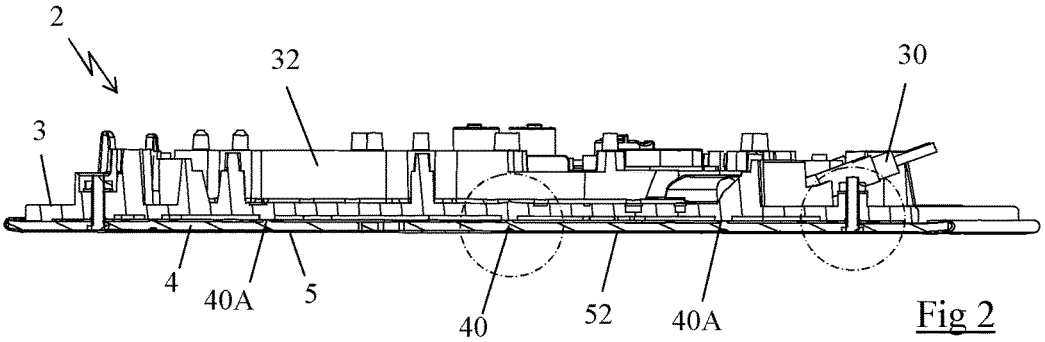
FIG. 2 is a longitudinal cross-section view of the soleplate of the iron in FIG. 1.

FIG. 1 represents an iron comprising a casing (1) made of plastic, comprising a handle and a heel on which the iron can rest vertically. The casing (1) encapsulates, in a self-explanatory manner, a reservoir provided with a refill opening (10) and comprises a cord (11) for supplying electricity to the iron through a 220 V residential network.

As shown in FIGS. 2 through 6, the iron comprises a soleplate (2) comprising a heating body (3) made of cast aluminum including a tubular electric resistor (30) that can reach 2300 W of power and that is the only heating element of the iron. The power supply to this electric resistor (30) is regulated by a thermostat, not depicted in the drawings, which is attached to a housing (31) arranged on an upper surface of the heating body (3), the thermostat being advantageously regulated around a setpoint temperature of 165° C., which cannot be adjusted by the user.

Figure 4:
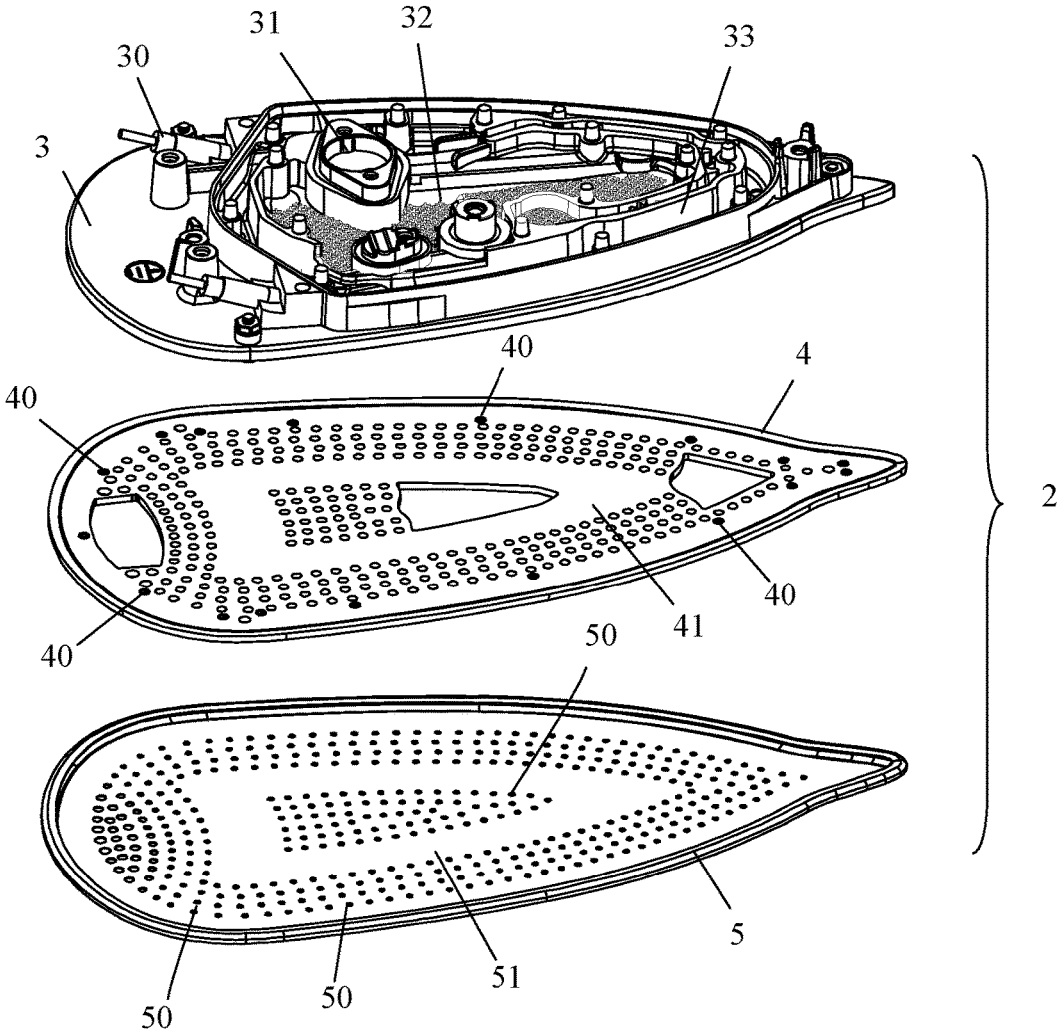
FIGS. 4 and 5 are respectively, top and bottom exploded perspective views of the soleplate of the iron in FIG. 1.
Figure 6:
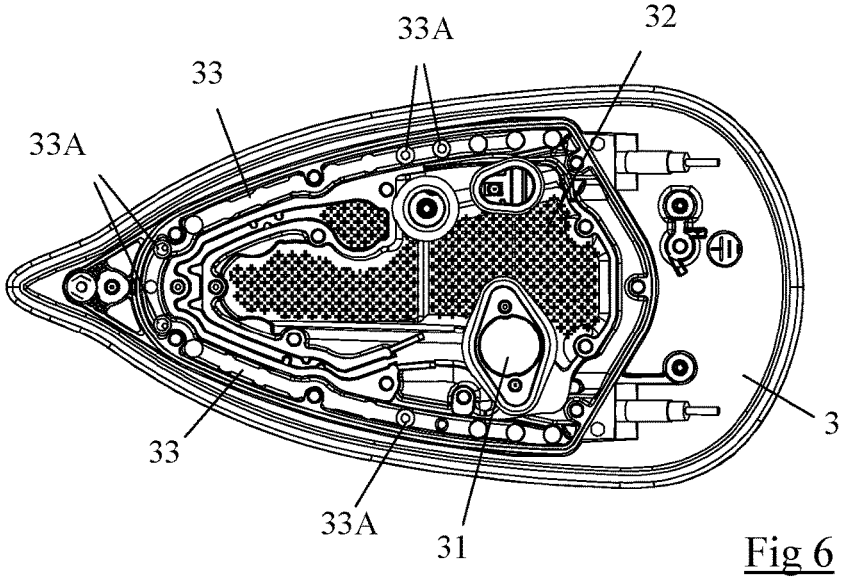
FIG. 6 is a view from above of the soleplate in FIG. 2.

As shown in FIGS. 4 and 6, the upper surface of the heating body (3) comprises protruding walls that define a steam chamber (32) supplied with water from the reservoir by a pump or a drip valve, not depicted in the drawings, and steam distribution channels (33) extending along the periphery of the steam chamber (32), these channels (33) meeting at the front end of the heating body (3).

The channels (33) comprise throughways (33A) passing through the heating body (3) and leading to a cavity arranged on the lower surface of the heating body (3) forming a steam distribution chamber (34).

The soleplate (2) comprises, beneath the heating body (3), an intermediate plate (4), advantageously made of aluminum, the upper surface of which comes into contact with the heating body (3) and defines one boundary wall of the steam distribution chamber (34).

The soleplate (2) also comprises a metal cap (5), advantageously made of stainless steel, which is pressed against the lower surface of the plate (4), the metal cap (5) coming into direct contact with the plate (4) and being advantageously attached to the latter by bending the peripheral edge of the cap (5) around the peripheral edge of the plate (4).

The cap (5) comprises, in a self-explanatory manner, a flat lower surface that defines an ironing surface (52) designed to come into contact with the fabric to be ironed. This ironing surface (52) is advantageously provided with over two hundred steam release holes (50) with a throughway section of less than 4 $mm^2$, as described in greater detail in patent application EP 1 772 551 filed by the applicant. The steam release holes (50) are advantageously distributed along a first and second network of steam release holes (50) separated from one another by a median zone (51) without any steam release holes.

Figure 3A:
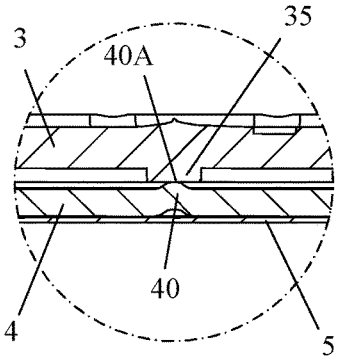
FIGS. 3A and 3B are enlarged views of the cross-section view in FIG. 2, at one point of contact and of an attachment screw, respectively.
Figure 5:
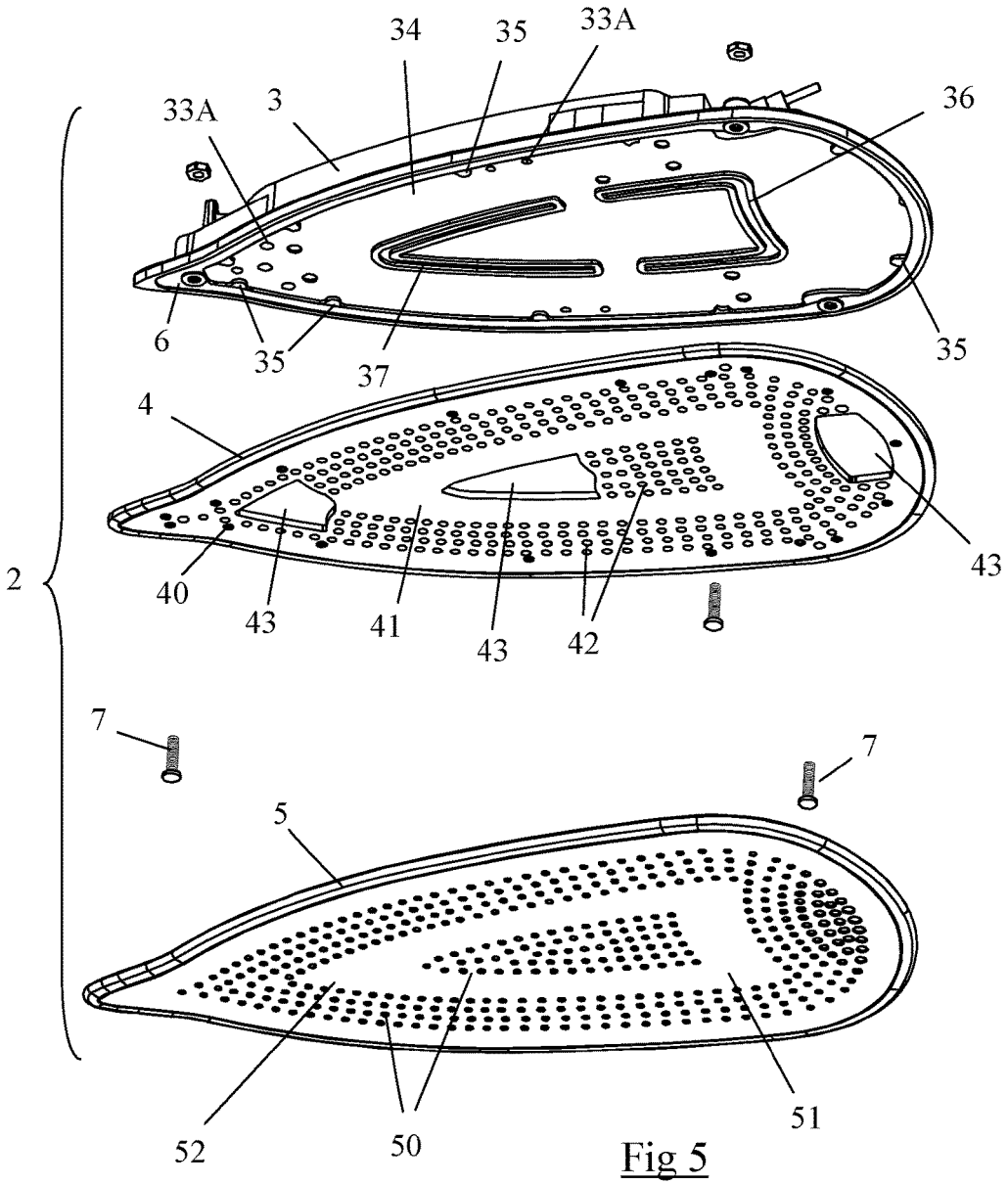

As shown in FIGS. 3A, 4 and 5, the plate (4) comprises several bosses (40) in relief, the upper ends of which form points of contact (40A) between the plate (4) and the heating body (3), the heating body (3) comprising, facing each of these bosses, a stop (35) provided with a flat surface against which the boss (40) abuts when the plate (4) is assembled against the heating body (3).

These bosses (40) are preferably made by a stamping process in the plate (4) and have a roughly spherical upper surface.

Figure 7:
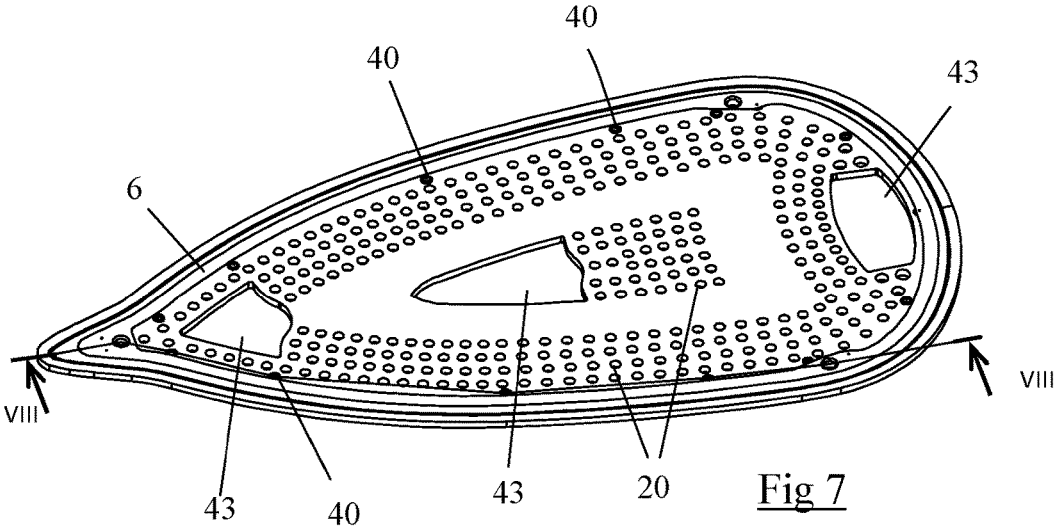
FIG. 7 is a perspective view from above of the plate equipping the iron in FIG. 1.
Figure 8:
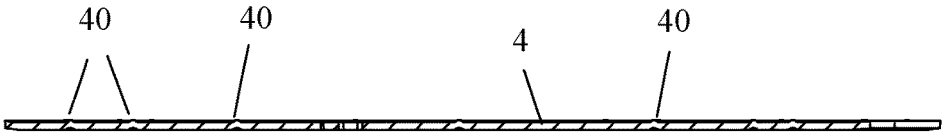
FIG. 8 is a cross-section view of the plate along the line VIII-VIII in FIG. 7.

Each boss (40) advantageously protrudes to a height on the order of 0.6 mm above the upper surface of the plate (4). A silicone gasket (6), depicted in FIGS. 5 and 7, is placed between the plate (4) and the heating body (3) over the entire perimeter of the distribution chamber (34) to ensure imperviousness to steam, this silicone gasket (6) also being 0.6 mm thick.

The upper end of each boss (40) forms a point of contact (40A) that has a contact surface area of less than 2 $mm^2$ and preferably less than 1 $mm^2$. In the particular example of embodiment depicted in the drawings, the plate (4) has a thickness on the order of 2 mm and comprises seventeen bosses (40) distributed over the periphery of the plate (4), the bosses (40) having a contact surface with the stops (35) consisting of a circular surface with a diameter on the order of 1 mm.

Preferably, the contact surfaces of the bosses (40) are the only areas where the plate (4) is directly in contact with the heating body (3), such that the heat transfer by conduction between the heating body (3) and the plate (4) occurs only through these bosses (40).

Advantageously, the plate (4) is attached against the heating body (3) by three screws (7), shown in FIG. 5, one of the screws (7) being arranged near a front tip of the soleplate (2) and the two other screws being arranged symmetrically on the edge of the plate (4) in the back part of the soleplate (2).

Figure 3B:
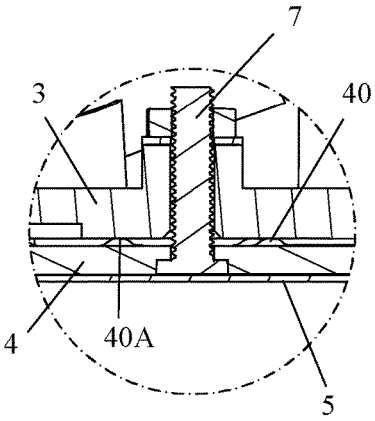

As shown in greater detail in FIG. 3B, the plate (4) is not in direct contact with the heating body (3) in the location of the screws (7) in order to limit the thermal transfer by conduction in that area.

As shown in FIG. 5, the heating body (3) also comprises grooves (36, 37) that protrude into the steam distribution chamber (34), these grooves (36, 37) being situated in a median zone of the soleplate (2) and facing a median zone (41) of the plate (4) without holes. The height of these grooves (36, 37) is adapted so that they do not come into direct contact with the plate (4) when the plate (4) is assembled onto the heating body (3) with the bosses (40) abutting the stops (35), a silicone gasket, not depicted in the drawings, being present to fill the resulting space between the grooves (26, 27) and the plate (4) to ensure a mechanical connection between the plate (4) on the heating body (3) in addition to the attachment screws.

In the particular example of embodiment depicted, the grooves (36, 37) consist of a first groove (36) being generally U-shaped, and a second groove (37) being generally V-shaped, each of these grooves (36, 37) having a recess forming a cavity into which the silicone gasket is injected, this gasket covering the grooves (36, 37) to a height of 0.5 mm, to come into contact with the plate (4) and to help attach said plate.

The plate (4) comprises, on either side of the median zone (41), openings (42, 43) making it possible to diffuse the steam from the distribution chamber (34) toward the cap (5), the cap (5) comprising, facing each opening (42, 43), at least one steam release hole (50).

Advantageously, most of the openings (42) of the plate (4) have a diameter corresponding roughly to the diameter of the steam release hole (50) of the cap (5) facing it, such that the plate (4) is in direct contact with the cap (5) near the steam release holes (50) and can transfer the heat by conduction in this area.

Certain openings (43) on the plate (4) can nevertheless have a larger surface area to limit local heat transfer by conduction. Thus, in the example depicted, the plate (4) comprises three larger openings (43) situated near the front tip, in the central area of the soleplate (2) and near the back part of the plate (4), respectively, each of these openings supplying several steam release holes in the cap (5).

The iron thus produced offers the advantage of possessing a cap (5) provided with an ironing surface with a relatively even temperature on the order of 140° C. when the steam chamber (32) is at a temperature on the order of 165° C., making it possible to produce a continual flow of steam on the order of 35 g/min.

Indeed, in the construction of the soleplate (2) thus produced, the thermal transfer by conduction between the heating body (3) and the plate (4) is limited to only the points of contact (40A) situated at the end of the bosses (40), said bosses having a very small surface area, the rest of the heat transfer occurring by radiation through the distribution chamber (34). The significant number of points of contact (40A) and their small surface area make it possible to have excellent control of the heat flow established by conduction between the heating body (3) and the plate (4). Moreover, the significant number of points of contact (40A) also make it possible to obtain good control of the distance separating the bottom of the cavity forming the distribution chamber (34) and the plate (4), which makes it possible to have excellent control of the heat flow established by radiation between the heating body (3) and the plate (4).

Finally, such points of contact (40A), held by bosses (40) made by stamping the plate (4), offer the benefit of being very inexpensive to produce. They also offer the advantage of being very small in size, making it possible to obtain a very compact soleplate (2) construction.

Moreover, the presence of the aluminum plate (4), which possesses high thermal conductivity, also helps to improve the evenness of the temperature on the ironing surface. Indeed, if a temperature gradient appeared between different points of the plate (4), it would quickly be attenuated by the thermal transfer that is then established in the thickness of the plate (4).

Thus obtained is an iron with a compact construction that is inexpensive to implement and with a temperature on the ironing surface that is roughly constant at around 140° C., for ironing all types of textiles without damaging them. In addition, such a construction makes it possible to maintain the temperature of the heating body in the immediate vicinity of the steam chamber at around 165° C., which makes it possible to produce a continuous steam output on the order of 35 g/min that is sufficient to ensure great efficacy in ironing.

Of course, the invention is in no way limited to the embodiment described and depicted, which has been provided only as an example. Modifications remain possible, particularly with regard to the makeup of the various components or by substituting equivalent techniques, while still remaining within the scope of protection of the invention.

Thus, in one embodiment variation not depicted, the bosses in relief can be made by molding, and said bosses can be produced on the heating body rather than on the plate.

Thus, in one embodiment variation not depicted, the aluminum plate/stainless steel cap set could be replaced by a single aluminum plate, the lower surface of which directly constitutes the ironing surface.

Thus, in one embodiment variation, the iron may comprise a heating element, the power of which is limited to 1600 W when the residential electrical network is on the order of 120 V.

The invention claimed is:

1. Steam iron comprising a heating body comprising a steam chamber and an ironing surface thermally connected to the heating body, the ironing surface being designed to come into contact with the fabric to be ironed and being provided with steam release holes, heat produced by the heating body being transferred to the ironing surface by conduction through at least two components of the iron, pressed against one another, wherein the two components are in direct contact with one another at least one point of contact with a contact surface area of less than 2 $mm^2$, wherein the two components are in direct contact with one another at several points of contact, all of the points of contact having a contact surface area of less than 2 $mm^2$.

2. Iron according to claim 1, wherein the iron comprises at least three points of contact between the two components.

3. Iron according to claim 1, wherein the points of contact are situated at an end of protrusions extending beyond one surface of at least one of the components.

4. Iron according to claim 3, wherein the protrusions are obtained by a stamping process.

5. Iron according to claim 3, wherein one or more protrusions extend to a height of over 0.3 mm.

6. Iron according to claim 1, wherein a steam distribution chamber is arranged between the two components.

7. Iron according to claim 6, wherein a gasket is positioned between the two components at a periphery of the distribution chamber.

8. Iron according to claim 1, wherein the iron includes a soleplate which comprises a plate that is pressed against the heating body and wherein the at least one point of contact is situated at an interface between the heating body and the plate.

9. Iron according to claim 8, having a plurality of points of contact which are distributed along a periphery of the ironing surface.

10. Iron according to claim 8, wherein said plate is made of aluminum.

11. Iron according to claim 10, wherein the iron comprises a cap, made of stainless steel, which is connected to said plate, wherein the ironing surface is supported by said cap.

12. Iron according to claim 11, wherein the plate is attached to the heating body by means of screws, the cap being attached to the plate by folding edges of the cap over edges of the plate.

13. Iron according to claim 11, wherein the plate has openings arranged facing steam release holes in the cap.

14. Iron according to claim 1, wherein the heating body is a casting encapsulating an electric resistor.

15. Iron according to claim 1, wherein the two components are in direct contact with one another at several points of contact, all of the points of contact having a contact surface area of less than 1 $mm^2$.

16. Iron according to claim 1, wherein the iron comprises a number of points of contact between the two components within a range of between 10 and 30.

17. Iron according to claim 3, wherein one or more protrusions extend to a height of between 0.4 mm and 0.8 mm.

* * * * *